US008878884B2

(12) United States Patent
Kawaguchi et al.

(10) Patent No.: US 8,878,884 B2
(45) Date of Patent: Nov. 4, 2014

(54) ERASING APPARATUS FOR SHEET AND ERASING METHOD FOR SHEET

(75) Inventors: Takahiro Kawaguchi, Shizuoka (JP); Yoshiaki Sugizaki, Shizuoka (JP); Hiroyuki Taki, Shizuoka (JP); Isao Yahata, Shizuoka (JP); Ken Iguchi, Shizuoka (JP); Kikuo Mizutani, Shizuoka (JP); Hiroyuki Tsuchihashi, Shizuoka (JP); Chiaki Iizuka, Shizuoka (JP); Hidetoshi Yokochi, Shizuoka (JP); Toshiaki Oshiro, Shizuoka (JP); Hiroyuki Hazu, Shizuoka (JP); Yoichi Yamaguchi, Shizuoka (JP); Hiroyuki Sugiyama, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 20 days.

(21) Appl. No.: 13/484,195

(22) Filed: May 30, 2012

(65) Prior Publication Data

US 2013/0002782 A1 Jan. 3, 2013

Related U.S. Application Data

(60) Provisional application No. 61/502,227, filed on Jun. 28, 2011, provisional application No. 61/502,247, filed on Jun. 28, 2011, provisional application No. 61/521,352, filed on Aug. 8, 2011.

(51) Int. Cl.
*B41J 29/16* (2006.01)
*G03G 15/00* (2006.01)

(52) U.S. Cl.
CPC .... *G03G 15/6585* (2013.01); *G03G 2215/0426* (2013.01)
USPC ..... 347/179

(58) Field of Classification Search
USPC ..... 347/179; 400/695, 697, 699; 358/474, 358/498; 250/316.1, 317.1, 319, 588
See application file for complete search history.

(56) References Cited

U.S. PATENT DOCUMENTS 5,391,872 A 2/1995 Itoh et al.
5,694,159 A 12/1997 Kajiya et al.
(Continued)

FOREIGN PATENT DOCUMENTS

JP 07-032624 2/1995
JP H07256978 10/1995
(Continued)

OTHER PUBLICATIONS

Office Action dated Mar. 11, 2014, filed in corresponding Japanese Patent Application No. 2012-128957, with English translation.

*Primary Examiner* — Kristal Feggins
(74) *Attorney, Agent, or Firm* — Patterson & Sheridan LLP

(57) ABSTRACT

According to one embodiment, an erasing apparatus for a sheet includes a conveying path configured to convey a sheet on which an image is formed with a coloring agent that is erased by heating, a first erasing section including, on an upstream side of the conveying path, a first heating member provided on one surface side of the sheet and a first rotating roller provided to be opposed to the first heating member, and a second erasing section including, on a downstream side of the first erasing section, a second heating member provided on the other surface side of the sheet and a second rotating roller provided to be opposed to the second heating member.

19 Claims, 10 Drawing Sheets

(56) References Cited

U.S. PATENT DOCUMENTS

| | | | | |
|---|---|---|---|---|
| 8,289,353 | B2 * | 10/2012 | Taguchi et al. | 347/179 |
| 8,441,508 | B2 * | 5/2013 | Taki et al. | 347/179 |
| 2006/0163505 | A1 * | 7/2006 | Tajima | 250/588 |
| 2009/0073507 | A1 * | 3/2009 | Fukuda | 358/474 |
| 2010/0118361 | A1 | 5/2010 | Iguchi | |
| 2010/0315475 | A1 | 12/2010 | Taki et al. | |
| 2011/0234736 | A1 * | 9/2011 | Taguchi et al. | 347/179 |

FOREIGN PATENT DOCUMENTS

| | | |
|---|---|---|
| JP | 08-244359 | 9/1996 |
| JP | H1078718 | 3/1998 |
| JP | 10-254315 | 9/1998 |
| JP | 2002-049258 | 2/2002 |
| JP | 2002-296934 | 10/2002 |
| JP | 2007-057900 | 3/2007 |
| JP | 2010-113337 | 5/2010 |

* cited by examiner

ERASING APPARATUS FOR SHEET AND ERASING METHOD FOR SHEET

CROSS-REFERENCE TO RELATED APPLICATION

This application is based upon and claims the priority of U.S. Provisional Application No. 61/502,227, filed on Jun. 28, 2011, U.S. Provisional Application No. 61/502,247, filed on Jun. 28, 2011 and U.S. Provisional Application No. 61/521,352, filed on Aug. 8, 2011, the entire contents of which are, incorporated herein by reference.

FIELD

Embodiments described herein relate generally to an erasing apparatus that erases an image on a sheet formed by an image forming apparatus.

BACKGROUND

In recent years, an image forming apparatus such as an MFP (Multi Function Peripheral) is used to form an image on a sheet. A decolorable coloring agent such as ink containing leuco dye is used to print an image on a sheet in order to make it possible to erase the image formed on the sheet and reuse the sheet. High temperature is applied the decolorable coloring agent to erase the decolorable coloring agent.

Therefore, when the sheet is reused, the sheet is heated using an erasing apparatus to erase the image formed on the sheet. The erasing the image formed on the sheet as explained above is referred to as "decoloring" in the following explanation.

In the decoloring apparatus, a platen roller and a heat source are arranged to be opposed to each other across a conveying path for the sheet. The decoloring apparatus conveys the sheet to between the platen roller and the heat source to thereby heat the sheet and erase the decolorable coloring agent.

If both the surfaces of the sheet are decolored, since the front surface and the rear surface of the sheet are decolored, excess operation power is consumed in the heating of the sheet. The sheet may be unable to be sufficiently preliminarily heated before the sheet reaches the position of the platen roller. Therefore, the decoloring is insufficient or heat higher than necessary needs to be applied to the sheet.

Further, since the sheet once used is conveyed to the decoloring apparatus, highly likely that the leading end portion of the sheet is bent or folded. Therefore, be difficult to guide the leading end of the sheet to a nip section in a stable state.

DETAILED DESCRIPTION

Figure 1:
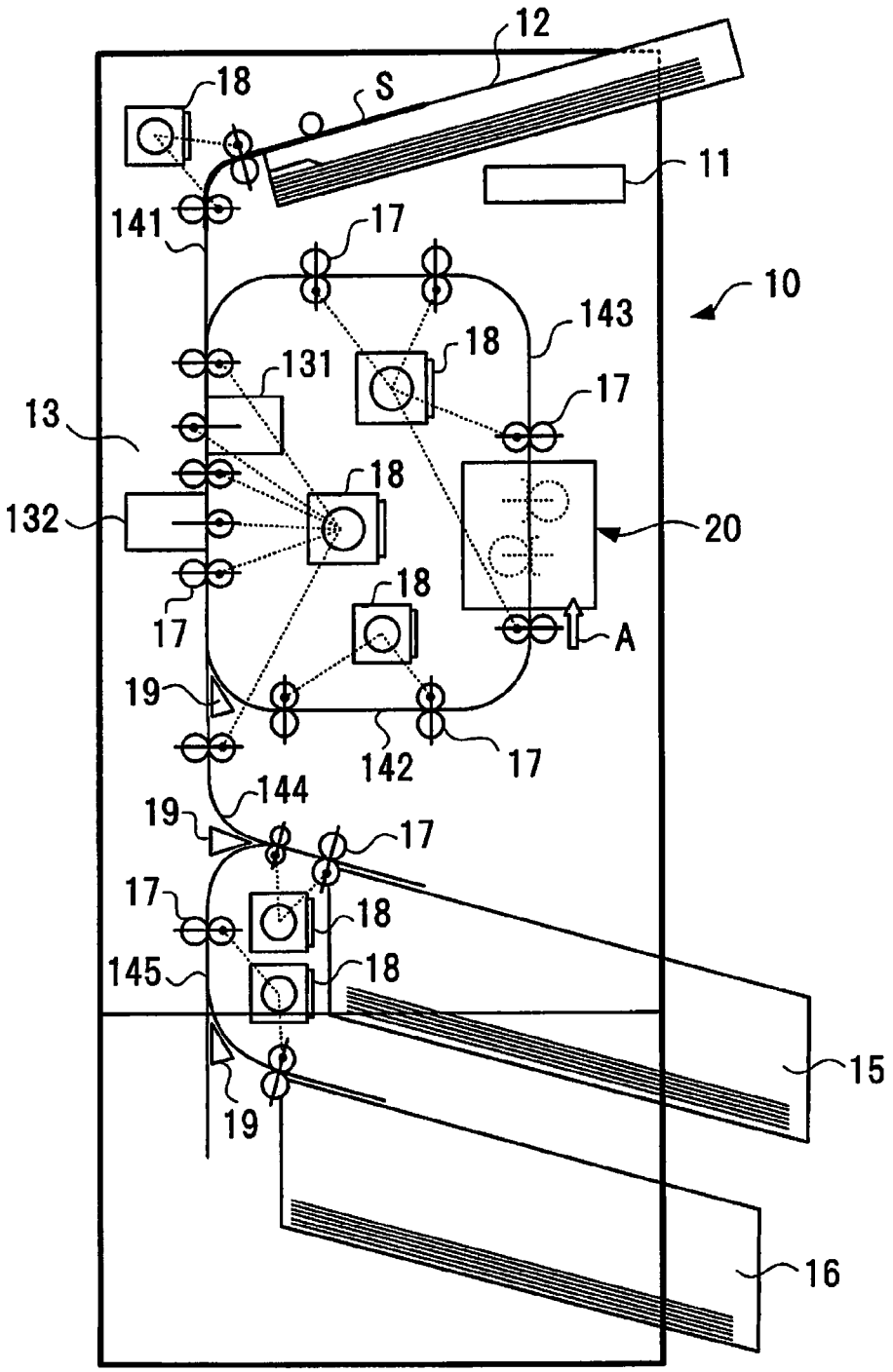
FIG. 1 is a configuration diagram of the inside of a decoloring apparatus for a sheet according to a first embodiment.

In general, according to one embodiment, an erasing apparatus for a sheet includes: a conveying path configured to convey a sheet on which an image is formed with a coloring agent that is erased by heating; a first erasing section including, on an upstream side of the conveying path, a first heating member provided on one surface side of the sheet and a first rotating roller provided to be opposed to the first heating member, the first erasing section being configured to convey the sheet according to the rotation of the first rotating roller while holding the sheet between the first heating member and the first rotating roller and heating the sheet; and a second erasing section including, on a downstream side of the first erasing section, a second heating member provided on the other surface side of the sheet and a second rotating roller provided to be opposed to the second heating member, the second erasing section being configured to convey the sheet according to the rotation of the second rotating roller while holding the sheet between the second heating member and the second rotating roller and heating the sheet.

A decoloring apparatus (an erasing apparatus) according to a first embodiment is explained below with reference to the drawings. The same sections in the figures are denoted by the same reference numerals and signs.

FIG. 1 is a configuration diagram of the inside of the decoloring apparatus according to the first embodiment. A decoloring apparatus 10 includes an operation panel 11 including operation buttons and a display section, a paper feeding section 12, a scanner 13 functioning as a reading section, and a decoloring section (an erasing section) 20. The decoloring apparatus 10 includes a first conveying path 141, a second conveying path 142, a third conveying path 143, a fourth conveying path 144, a fifth conveying path 145, a first paper discharge tray 15, and a second paper discharge tray (a reject box) 16.

The conveying paths 141 to 145 include plural conveying rollers 17 in order to convey a sheet and include plural motors 18 that drive the plural conveying rollers 17. Plural gates 19 are provided in order to accurately convey the sheet to the conveying paths 141 to 145.

The first conveying path 141 conveys a sheet S from the paper feeding section 12 to the scanner 13. The second conveying path 142 conveys the sheet S from the scanner 13 to the decoloring section 20 in a direction indicated by an arrow A. The third conveying path 143 conveys the sheet S from the decoloring section 20 to the scanner 13 again. The fourth conveying path 144 conveys the sheet S from the scanner 13 to the first paper discharge tray 15. The fifth conveying path 145 conveys the sheet S from the scanner 13 to the reject box 16.

In the paper discharge tray 15, for example, a sheet that can be reused after an image thereon is subjected to decoloring processing is collected. In the reject box 16, a sheet that may be unable to be reused and is usually discarded and recycled is collected.

The decoloring apparatus 10 shown in FIG. 1 generally performs operations explained in (1) to (5) below.

(1) The decoloring apparatus 10 reads, with the scanner 13, the sheet S fed from the paper feeding section by the first conveying path 141. The scanner 13 includes a first scanner 131 and a second scanner 132 and reads both the surfaces of the sheet S. The scanner 13 reads, for example, image data before an image on the sheet is decolored. Further, the scanner 13 reads a print state of the sheet S.

(2) The decoloring apparatus 10 performs storage or the like of the image data read by the scanner 13. If the sheet S has a tear or a crease judging from the print state read by the scanner 13, the decoloring apparatus 10 leads the sheet S to the fifth conveying path 145 and conveys the sheet S to the reject box 16. If the sheet S does not have a tear or a crease, the decoloring apparatus 10 conveys the sheet S to the decoloring section 20 with the second conveying path 142.

(3) The sheet S conveyed to the decoloring section 20 is heated when the sheet S passes through the decoloring section 20. The decoloring section 20 decolors an image formed on the sheet S using heat. The decoloring section heats and presses the sheet S at relatively high temperature of, for example, 180 to 200° C. and decolors the image on the sheet S formed with a decolorable coloring agent. A specific configuration of the decoloring section 20 is explained below.

(4) The decoloring apparatus 10 conveys, with the third conveying path 143, the sheet S passed through the decoloring section 20 to the scanner 13 again. The scanner 13 reads a print state again in order to check whether the image formed with the decolorable coloring agent in an image area is surely decolored.

(5) The decoloring apparatus 10 conveys, with the fourth conveying path 144, the sheet S to be reused to the first paper discharge tray 15. If an image formed with an undecolorable coloring agent in the image area or a hand-drawn image remains judging from the print state read by the scanner 13, the decoloring apparatus 10 conveys the sheet S to the reject box 16 with the fifth conveying path 145. Further, the decoloring apparatus 10 conveys the sheet S having a tear or a crease to the reject box 16 with the fifth conveying path 145.

The specific configuration of the decoloring section 20 is explained.

Figure 2:
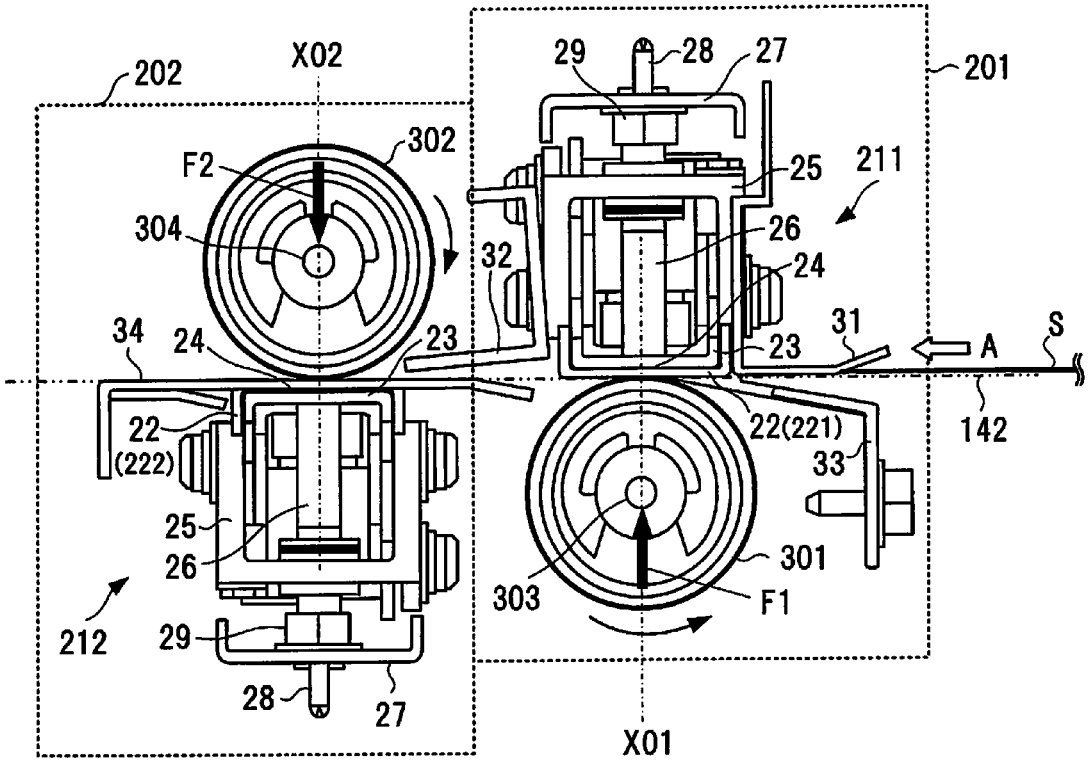
FIG. 2 is a side view of the configuration of first and second decoloring sections in the first embodiment.
Figure 3:
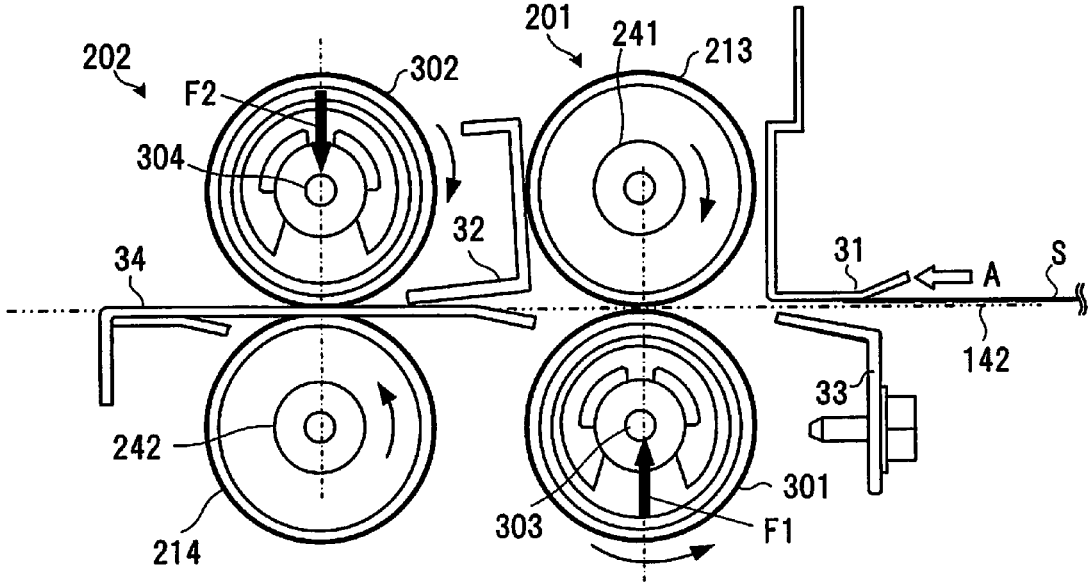
FIG. 3 is a side view of a modification of the first and second decoloring sections in the first embodiment.

FIG. 2 is a side view of the configuration of the decoloring section 20. FIG. 3 is a side view of a modification of the decoloring section 20. First, the decoloring section 20 shown in FIG. 2 is explained.

In FIG. 2, the decoloring section 20 includes a first decoloring section 201 and a second decoloring section 202. The first decoloring section 201 includes a heating section 211 and a platen roller 301. The second decoloring section 202 includes a heating section 212 and a platen roller 302. The first decoloring section 201 and the second decoloring section 202 have the same configuration. However, upper and lower parts thereof are reversed. The platen roller 301 and the platen roller 302 are rotating rollers that respectively rotate about rotating shafts 303 and 304. The platen roller 301 and the platen roller 302 are formed in a cylindrical shape extending in the width direction of the sheet S.

The heating section 211 of the first decoloring section 201 is explained below. The sheet S is conveyed on the second conveying path 142 from an arrow A direction. The direction of the arrow A is equivalent to the direction of the arrow A in FIG. 1.

The heating section 211 includes a heating plate 22, which has a cross section formed in a U shape and a flat surface that comes into contact with the sheet S, and a pressing member 23. The heating section 211 includes a planar heater 24 (see FIG. 7) between the heating plate 22 and the pressing member 23. The heating plate 22, the pressing member 23, and the heater 24 configure a heating member.

The heater 24 is, for example, a planar heater formed of a meal foil (SUS304) sandwiched between insulating materials of polyimide (PI). The heater 24 has structural characteristics that the heater 24 is thin and excellent in flexibility. The heater 24 is formed of a thin material and is extremely fast in a temperature rise during heating. For the heating plate 22, a material excellent in heat conduction such as an aluminum alloy (A5052P-H34) is used.

The pressing member 23 is covered with a cover 25. A spring 26 for pressing is provided in the cover 25. A supporting member 27 is arranged in an upper part of the cover 25. The supporting member 27 supports the heater 24 to be parallel to the conveying path 142 for the sheet S. The supporting member 27 presses the heating member including the heater 24 in the direction of the conveying path 142 via the spring 26. The spring 26 is attached to the circumference of a shaft 28. The shaft 28 pierces through the cover 25 and the supporting member 27. The shaft 28 is fixed to the supporting member 27 by a bolt and nut 29. The supporting member 27 is fixed in the decoloring apparatus 10.

A guide plate 31 is attached to a side surface on a sheet carry-in side of the cover 25. A guide plate 32 is attached to a side surface on a sheet carry-out side of the cover 25. The guide plate 31 guides carry-in of the sheet S in cooperation with a guide plate 33. The guide plate 33 is fixed in the decoloring apparatus 10 to be opposed to the guide plate 31. The guide plate 32 guides carry-out of the sheet S in cooperation with a guide plate 34. The guide plate 34 is fixed in the decoloring apparatus 10 to be opposed to the guide plate 32. The guide plates 32 and 34 function as guides in carrying the sheet S into the second decoloring section 202. As the platen rollers 301 and 302, for example, a roller having a PFA tube wound around the surface thereof is used.

Components of the heating section 212 of the second decoloring section 202 are denoted by reference numerals same as those of the heating section 211. Explanation of a specific configuration of the heating section 211 is omitted. In the following explanation, the heating plate 22 of the heating section 211 is explained as a heating plate 221 and the heating plate 22 of the heating section 212 is explained as a heating plate 222.

Figure 4:
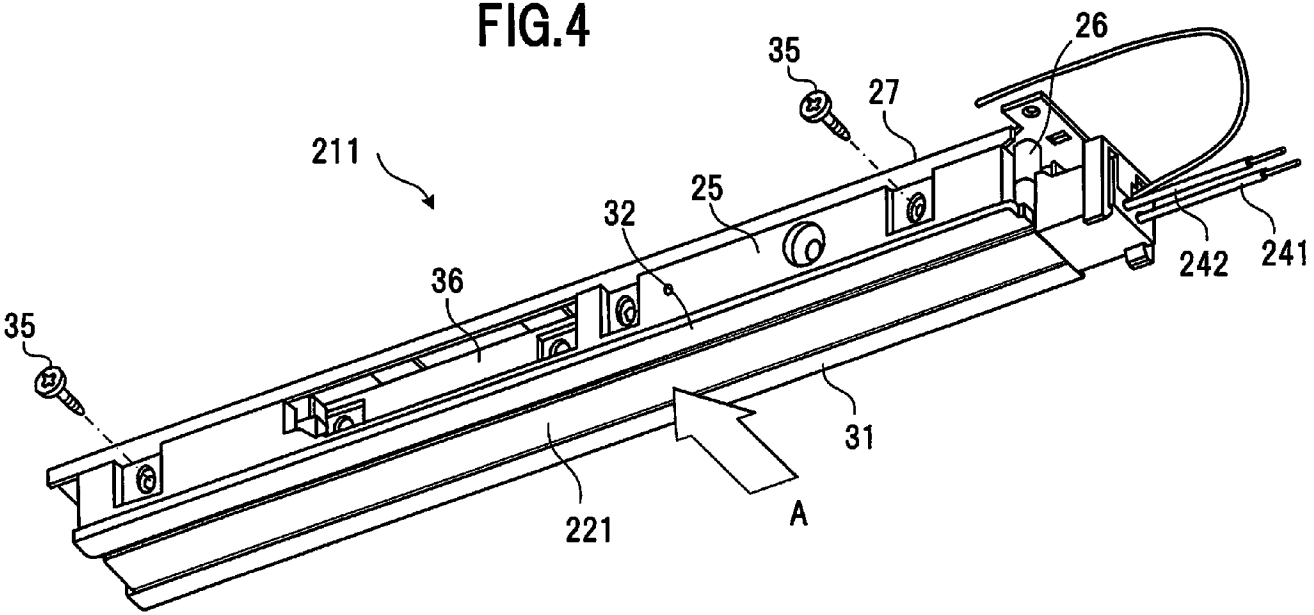
FIG. 4 is a perspective view of a heating section in the first embodiment viewed from the bottom thereof.
Figure 5:
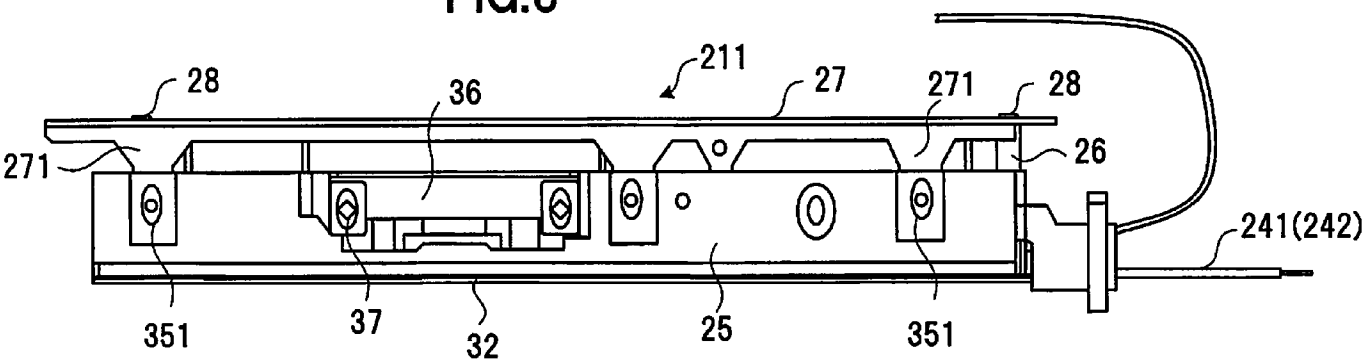
FIG. 5 is a front view of the heating section in the first embodiment.

FIG. 4 is a perspective view of the heating section 211 of the first decoloring section 201 shown in FIG. 2 viewed from the bottom of the heating section 211. FIG. 5 is a front view of the heating section 211.

As shown in FIGS. 4 and 5, the heating plate 221 is in contact with one surface of the sheet S conveyed from the arrow A direction. The heating plate 221 and the like are supported by the supporting member 27. In order to clearly show the configurations of the cover 25 and the supporting member 27, only surfaces of the guide plates 31 and 32 that come into contact with the sheet S are shown.

The supporting member 27 includes plural legs 271. The legs 271 are fixed to the cover 25 by screws 35. In FIG. 5, the screws 35 are omitted and screw holes 351 for attaching the screws 35 are shown. The screws 35 are also used in order to attach the guide plates 31 and 32 to the cover 25. A safety element 36 such as a thermostat is attached in the cover 25 in order to prevent abnormal overheat of the heater 24. The safety element 36 is attached to the cover 25 by screws 37.

Figure 6:
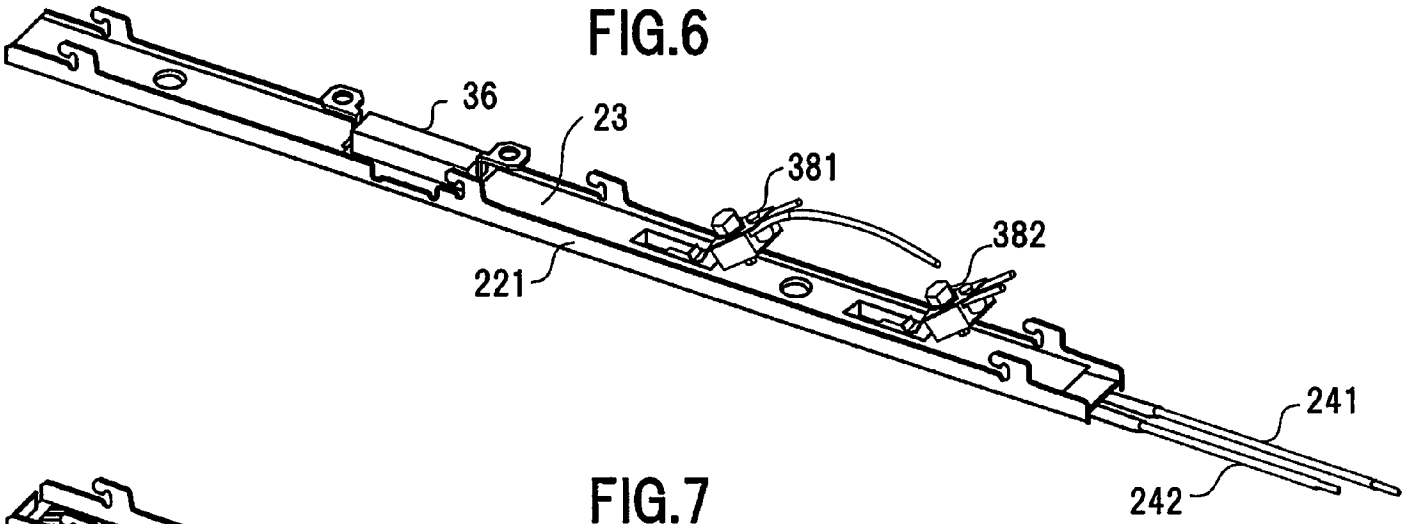
FIG. 6 is a perspective view of a heating plate and a pressing member in the first embodiment.
Figure 7:
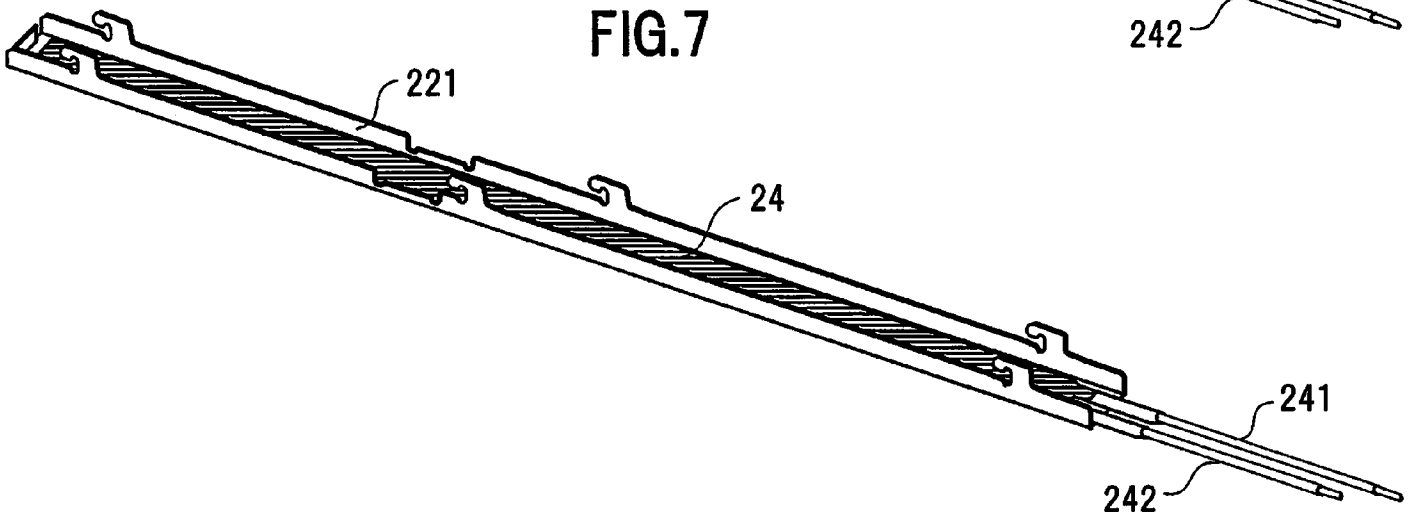
FIG. 7 is a perspective view of the heating plate and a heater in the first embodiment.

FIG. 6 is a perspective view of the heating plate 221 and the pressing member 23 included in the heating member. FIG. 7 is a perspective view of the heating plate 221 and the heater 24.

As shown in FIG. 7, the heating plate 221 is formed in a U shape in cross section. The heater 24 is attached on the bottom of the heating plate 221. The heater 24 is a planar heater formed of a metal foil sandwiched between insulating materials of polyimide. A power supply is supplied to the heater 24 via cables 241 and 242.

As shown in FIG. 6, an upper part of the heater 24 is pressed by the pressing member 23. The planar heater 24 is held between the heating plate 221 and the pressing member 23.

Thermistors 381 and 382 are attached to the pressing member 23. The distal ends of the thermistors 381 and 382 are attached to detect the temperature of the heater 24. The two thermistors 381 and 382 are provided in order to detect the temperatures in center and side positions of the sheet S according to the size of the sheet S.

Referring back to FIG. 2, the platen rollers 301 and 302 are cylindrical rotating rollers that are in contact with a longitudinal direction of the heating plates 221 and 222. The platen rollers 301 and 302 rotate about the rotating shafts 303 and 304. The rotating shafts 303 and 304 are urged in the directions of the heating plates 221 and 222, whereby the sheet S is nipped by the heating plate 221 and the platen roller 301, nipped by the heating plate 222 and the platen roller 302, and conveyed while being heated.

In the first decoloring section 201, pressure (pinch pressure) for urging the platen roller 301 in the direction of the heating plate 221 is indicated by F1. In the second decoloring section 202, pressure (pinch pressure) for urging the platen roller 302 in the direction of the heating plate 222 is indicated by F2. A ratio of the pinch pressure F1 and the pinch pressure F2 is, for example, 3:2.

In order to apply the pinch pressure F1, for example, the rotating shaft 303 is pulled to the heating plate 221 side by a spring. In order to apply the pinch pressure F2, for example, the rotating shaft 304 is pulled to the heating plate 222 side by a spring.

Decoloring processing for the sheet S by the heating sections 211 and 212 and the platen rollers 301 and 302 is explained with reference to FIG. 2. The sheet S is guided by the guide plates 31 and 33 via the second conveying path 142 and carried into the decoloring section 20. The platen roller 301 of the first decoloring section 201 rotates counterclockwise and the platen roller 302 of the second decoloring section 202 rotates clockwise, whereby the sheet S is conveyed at speed set in advance.

The first decoloring section 201 present on an upstream side of a conveying path presses, with the pinch pressure F1, the platen roller 301 against and brings the platen roller 301 into contact with the heating plate 221. A contact point (indicated by an dashed line X01) of the platen roller 301 and the heating plate 221 forms a nip area where heat is transferred to the sheet S. The sheet S passes the nip area X01, whereby the surfaces of the sheet S are heated and an image formed on one surface (in FIG. 2, the upper surface) of the sheet S is decolored.

If the image is formed on the sheet S using a decolorable coloring agent, the coloring agent is decolored when the coloring agent reaches specified temperature. The heating plate 221 is uniformly heated by the planar heater 24 and maintained at decolorable temperature. The temperature of the heating plate 221 is detected by the thermistors 381 and 382 and maintained at proper temperature on the basis of a result of the temperature detection.

The sheet S discharged from the first decoloring section 201 is guided by the guide plates 32 and 34 and carried into the second decoloring section 202. In the second decoloring section 202 present on a downstream side of the conveying path, a vertical relation between the platen roller 302 and the heating section 212 is reversed from that in the first decoloring section 201. The second decoloring section 202 presses, with the pinch pressure F2, the platen roller 302 against and brings the platen roller 302 into contact with the heating plate 222.

A contact point (indicated by an dashed line X02) of the platen roller 302 and the heating plate 222 forms a nip area where heat is transferred to the sheet S. The sheet S passes the nip area X02, whereby the surfaces of the sheet S are heated and an image formed on the other surface (in FIG. 2, the lower surface) of the sheet S is decolored. The sheet S decolored on both the surfaces is discharged along the guide plate 34 and sent to the third conveying path 143 (FIG. 1).

The first decoloring section 201 and the second decoloring section 202 have the same configuration. However, since the first decoloring section 201 and the second decoloring section 202 are arranged to be vertically reversed, one surface of the sheet S is decolored by the first decoloring section 201 and the other surface of the sheet S is decolored by the second decoloring section 202. Therefore, possible to efficiently decolor both the surfaces of the sheet S.

In decoloring the sheet S with the first decoloring section 201 and the second decoloring section 202, necessary to efficiently heat the sheet S with the first decoloring section 201 on the upstream side of the conveying path and raise the temperature of the sheet S. Therefore, the pinch pressure F1 of the platen roller 301 of the first decoloring section 201 is set high. And possible to efficiently heat the sheet S by setting the pinch pressure F1 high. On the other hand, when the sheet S reaches the second decoloring section 202 on the downstream side, since the sheet S already passes through the first decoloring section 201, the temperature of the rear surface can also be raised. Therefore, possible to set a heating amount for decoloring the rear surface low with respect to a heating amount for decoloring the front surface and reduce power consumption.

Further, possible to set the pinch pressure F2 of the platen roller 302 smaller than the pinch pressure F1 of the platen roller 301. Since the pinch pressure F2 of the platen roller 302 is set small compared with the pinch pressure F1 of the platen roller 301, possible to reduce a mechanical load. Therefore, be possible to reduce operating power.

FIG. 3 is a side view of a modification of the first and second decoloring sections 201 and 202. In FIG. 3, a heating roller 213 is used as a heating section of the first decoloring section 201 and a heating roller 214 is used as a heating section of the second decoloring section 202. The heating rollers 213 and 214 have a cylindrical shape and respectively include heat sources 241 and 242 such as halogen lamps on the inside. The heating roller 213 is set in contact with the platen roller 301 and the heating roller 214 is set in contact with the platen roller 302. The heating rollers 213 and 214 respectively rotate in directions for conveying the sheet S.

In the configuration shown in FIG. 3, as in the configuration shown in FIG. 2, one surface (the front surface) of the sheet S is decolored by the first decoloring section 201 and the other surface (the rear surface) of the sheet S is decolored by the second decoloring section 202. Be possible to set the pinch pressure F2 of the platen roller 302 smaller than the pinch pressure F1 of the platen roller 301. And, be possible to set a heating amount for decoloring the rear surface low with respect to a heating amount for decoloring the front surface.

Second Embodiment

Figure 8:
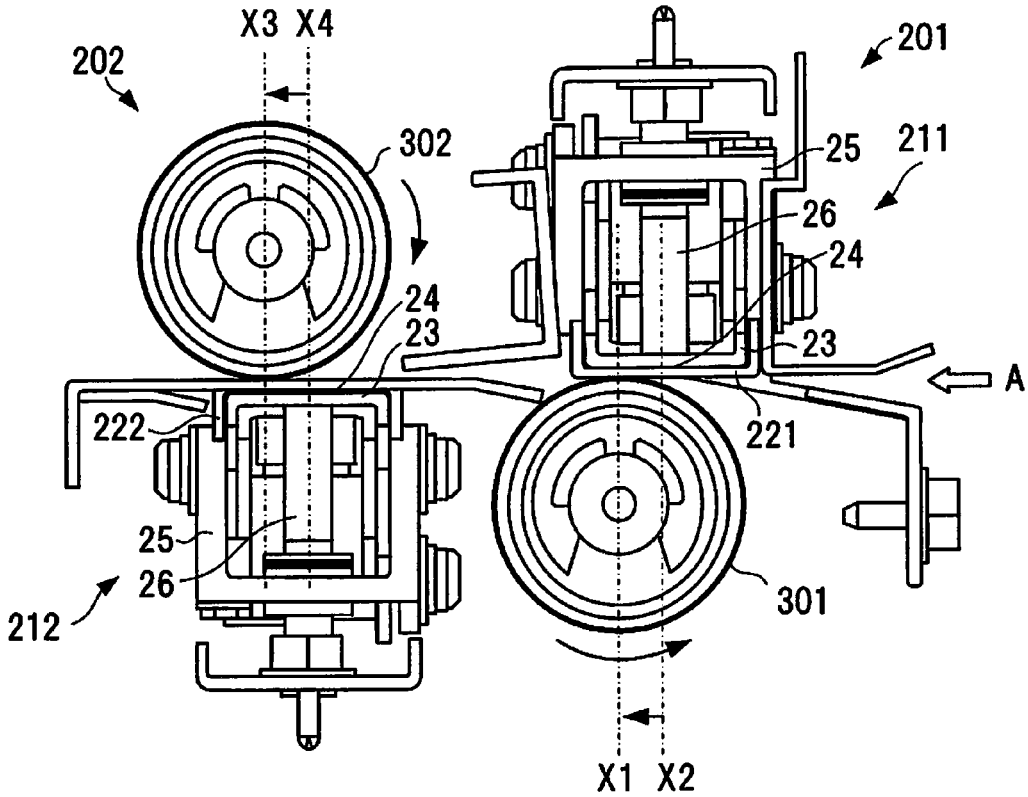
FIG. 8 is a side view of the configuration of first and second decoloring sections in a second embodiment.
Figure 9:
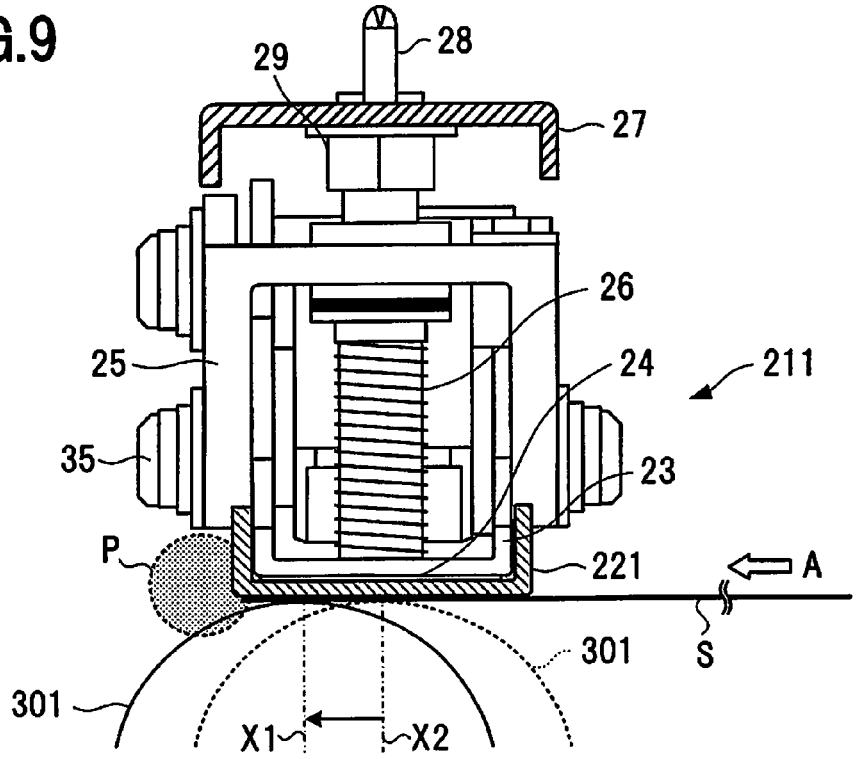
FIG. 9 is an enlarged side view of a heating section of the first decoloring section in the second embodiment.

The decoloring apparatus 10 according to a second embodiment is explained with reference to FIGS. 8 and 9. In FIG. 8, for convenience of illustration, only main components are denoted by reference numerals and signs. In FIG. 9, the heating section 211 of the first decoloring section 201 is shown in enlargement.

In FIG. 8, a nip area X1 where the heating plate 221 and the platen roller 301 of the first decoloring section 201 are in contact with each other is present in a position shifted further to the downstream side than the center in a sheet feeding direction (indicated by an dashed line X2) of the heating plate 221. A nip area X3 where the heating plate 222 and the platen roller 302 of the second decoloring section 202 are in contact with each other is present in a position shifted further to the downstream side than the center in a sheet feeding direction (indicated by an dashed line X4) of the heating plate 222.

Since the nip areas are shifted to the downstream side from the centers of the heating plates 221 and 222, possible to increase distances from ends on carry-in sides of the heating plates 221 and 222 to the nip areas. Therefore, possible to preheat the sheet surfaces of the sheet S with the heating plates 221 and 222 while the sheet S moves to the nip areas.

The sheet S moves while sliding over the surfaces of the planar heating plates 221 and 222 and is guided to the nip areas. Therefore, possible to guide the sheet S to the nip areas in a state in which flopping of the leading end of the sheet S is suppressed and the sheet S is aligned.

The decoloring apparatus 10 heats the sheet S used by a user several times and decolors images on recording surfaces of the sheet S. Therefore, unlike a virgin sheet, since the sheet S used once is conveyed, extremely important to guide the sheet S to the nip areas in a stable state.

Since the nip areas X1 and X3 are arranged in the positions shifted further to the downstream side of the conveying path for the sheet S than the centers (X2 and X4) of the heating plates 221 and 222, the sheet S is preliminarily heated before reaching the nip areas and adhesion of the sheet S and the heating plates 221 and 222 is improved. Therefore, possible to facilitate heating of the sheet surfaces in the nip areas and efficiently move heat generated from the heater 24 to the sheet S.

As indicated by a dotted line in FIG. 9, if the platen roller 301 is located in the center (X2) of the heating plate 221, the nip area is shifted to the upstream side of the conveying path. When the nip area is shifted to the upstream side, likely that a residual coloring agent melted by the heating of the sheet S is conveyed while being rubbed between the sheet surface and the heating plate 221 and dregs of the coloring agent accumulate at the end on the downstream side (indicated by a circle P in FIG. 9) of the heating plate 221. Therefore, the nip area X1 is provided as close as possible to the end on the downstream side of the heating plate 221. Consequently, be possible to reduce the accumulation of the dregs of the coloring agent.

When the sheet S is decolored by the first decoloring section 201 and the second decoloring section 202, necessary to efficiently heat the sheet S with the first decoloring section 201 on the upstream side of the conveying path and raise the temperature of the sheet S. Therefore, the pinch pressure F1 of the platen roller 301 of the first decoloring section 201 is set high. Consequently, be possible to efficiently heat the sheet S. On the other hand, when the sheet S reaches the second decoloring section 202 on the downstream side, since the sheet S already passes through the first decoloring section 201, be possible to raise the temperature of the rear surface as well. Therefore, possible to reduce a heating amount for decoloring the rear surface and set the pinch pressure F2 of the platen roller 302 smaller than the pinch pressure F1 of the platen roller 301.

Since the pinch pressure F2 of the platen roller 302 is set small compared with the pinch pressure F1 of the platen roller 301, possible to reduce a mechanical load. Therefore, be possible to reduce operating power.

Third Embodiment

Figure 10:
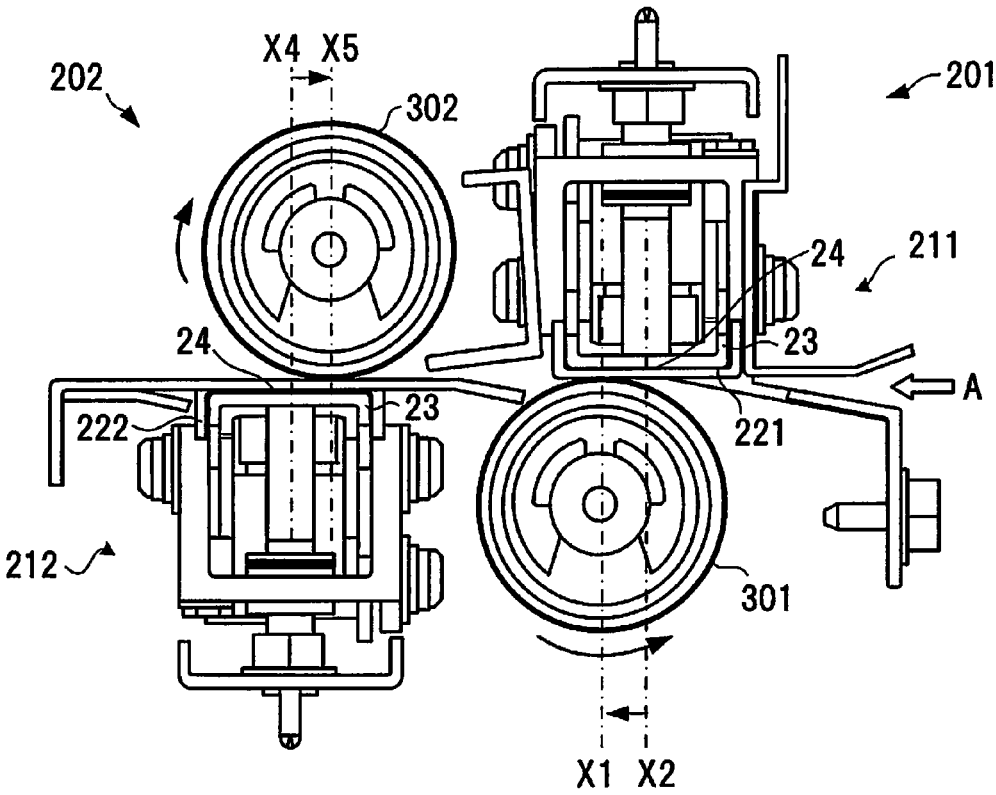
FIG. 10 is a side view of the configuration of first and second decoloring sections in a third embodiment.

The decoloring apparatus 10 according to a third embodiment is explained with reference to FIG. 10. In FIG. 10, for convenience of illustration, only main components are denoted by reference numerals and signs.

FIG. 10 is a side view of the configuration of the first decoloring section 201 and the second decoloring section 202 in the third embodiment. In FIG. 10, the nip area X1 of the heating plate 221 and the platen roller 301 of the first decoloring section 201 is present in a position shifted further to the downstream side of the conveying path for the sheet S than the center (indicated by the dashed line X2) of the heating plate 221. A nip area of the heating plate 222 and the platen roller 302 of the second decoloring section 202 is present in a position (indicated by an dashed line X5) shifted further to the upstream side of the conveying path for the sheet S than the center (indicated by the dashed line X4) of the heating plate 222.

Naturally, the temperature of the sheet S passed through the first decoloring section 201 upstream in the conveying path rises. When the sheet S directly conveyed by the platen roller 301 reaches the second decoloring section 202 downstream in the conveying path, although the temperature drops after the sheet S passes through the first decoloring section 201, the sheet S still has heat. On the other hand, in the second decoloring section 202, the nip area (X5) of the platen roller 302 and the heating plane 222 is arranged further on the upstream side than the center (X4) of the heating plate 222. Therefore, possible to immediately heat the sheet S with the second decoloring section 202 before the sheet S heated by the first decoloring section 201 cools, and possible to decolor an image of the sheet S.

Therefore, a heat quantity for decoloring the rear surface with the second decoloring section 202 may be smaller than a heat quantity for decoloring the front surface with the first decoloring section 201, possible to reduce the power consumption of a heat source (the heater 24). Since the heat remains in the sheet S because of the heating plate 222 even after the sheet S passes the nip area X5, possible to prevent a sudden temperature change of the sheet S and reduce a curl of the sheet S.

Fourth Embodiment

Figure 11:
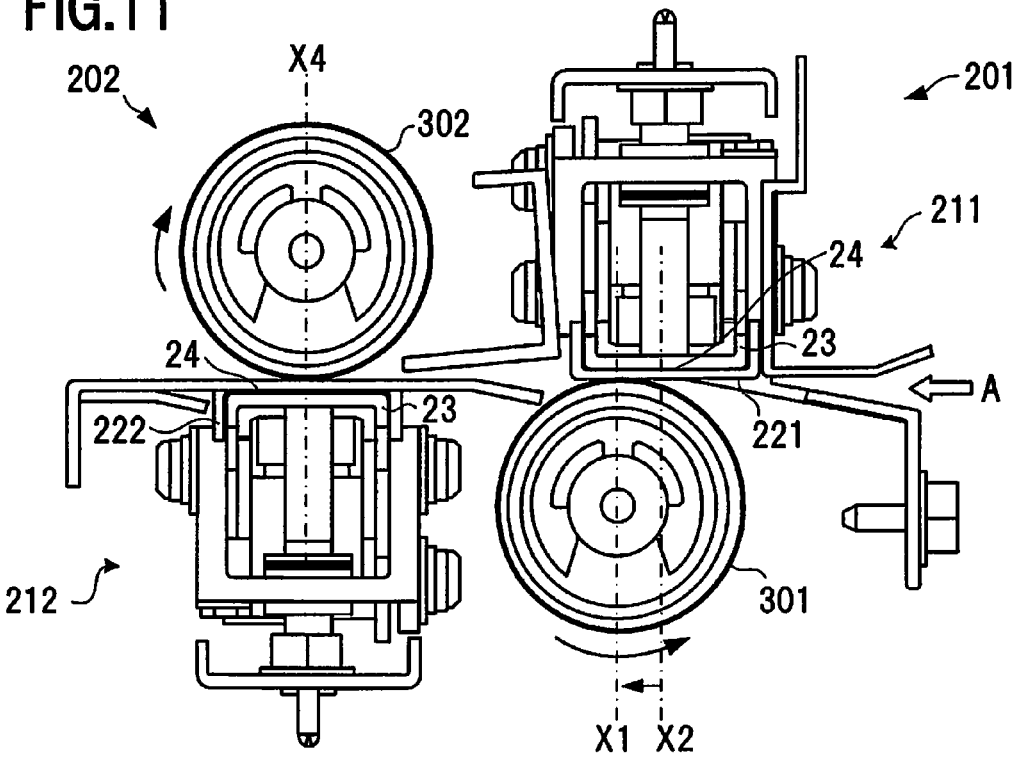
FIG. 11 is a side view of the configuration of first and second decoloring sections in a fourth embodiment.

The decoloring apparatus 10 according to a fourth embodiment is explained with reference to FIG. 11. In FIG. 11, for convenience of illustration, only main components are denoted by reference numerals and signs.

FIG. 11 is a side view of the configuration of the first decoloring section 201 and the second decoloring section 202 in the fourth embodiment. In FIG. 11, the nip area X1 of the heating plate 221 and the platen roller 301 of the first decoloring section 201 is present in a position shifted further to the downstream side of the conveying path for the sheet S than the center (indicated by the dashed line X2) of the heating plate 221. A nip area of the heating plate 222 and the platen roller 302 of the second decoloring section 202 is present in the center (indicated by the dashed line X4) of the heating plate 222.

The temperature of the sheet S passed through the first decoloring section 201 upstream in the conveying path rises. The sheet S is directly conveyed by the platen roller 301. When the sheet S reaches the second decoloring section 202 downstream in the conveying path, although the temperature drops a little, the sheet S still has heat. The sheet S is conveyed to the second decoloring section 202 in a state in which the sheet S is preliminarily heated.

On the other hand, in the second decoloring section 202, the platen roller 302 is arranged in the center of the heating plate 222 where heat is the most intense. Therefore, in the second decoloring section 202, even if the power consumption of the heat source (the heater 24) is reduced, possible to heat the sheet S at temperature necessary for decoloring and efficiently decolor the sheet S.

Fifth Embodiment

Figure 12:
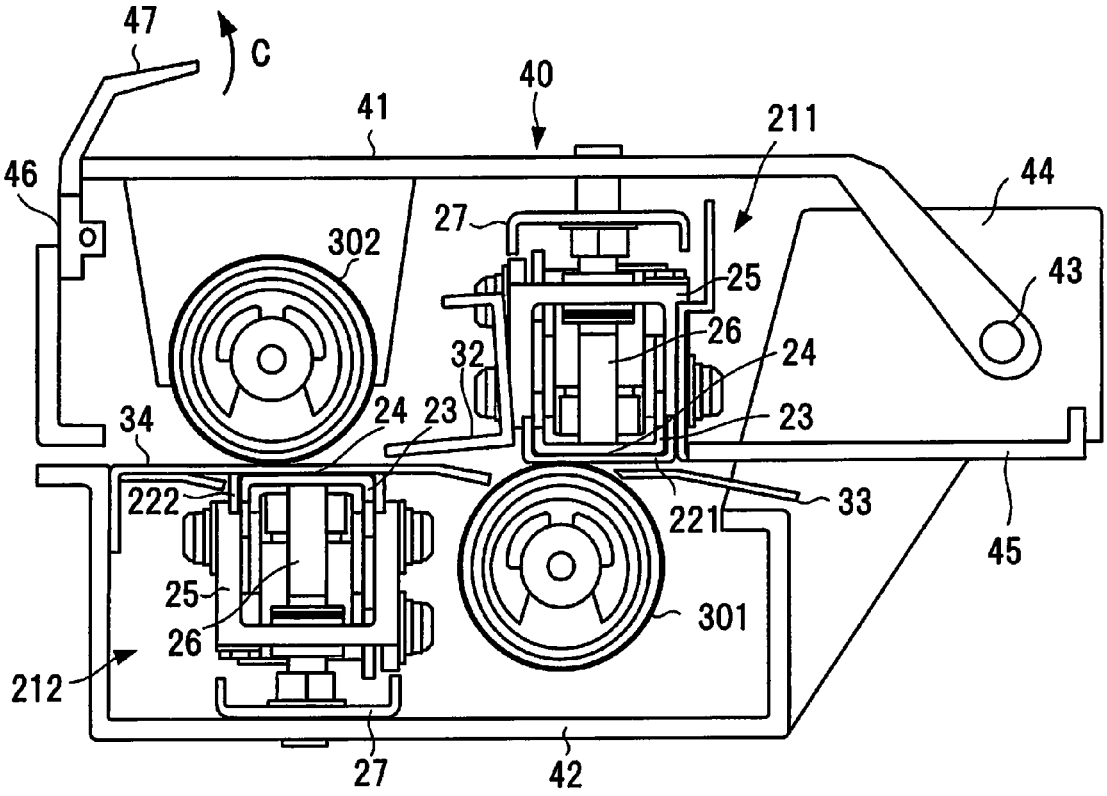
FIG. 12 is a side view of first and second decoloring sections in a fifth embodiment.
Figure 13:
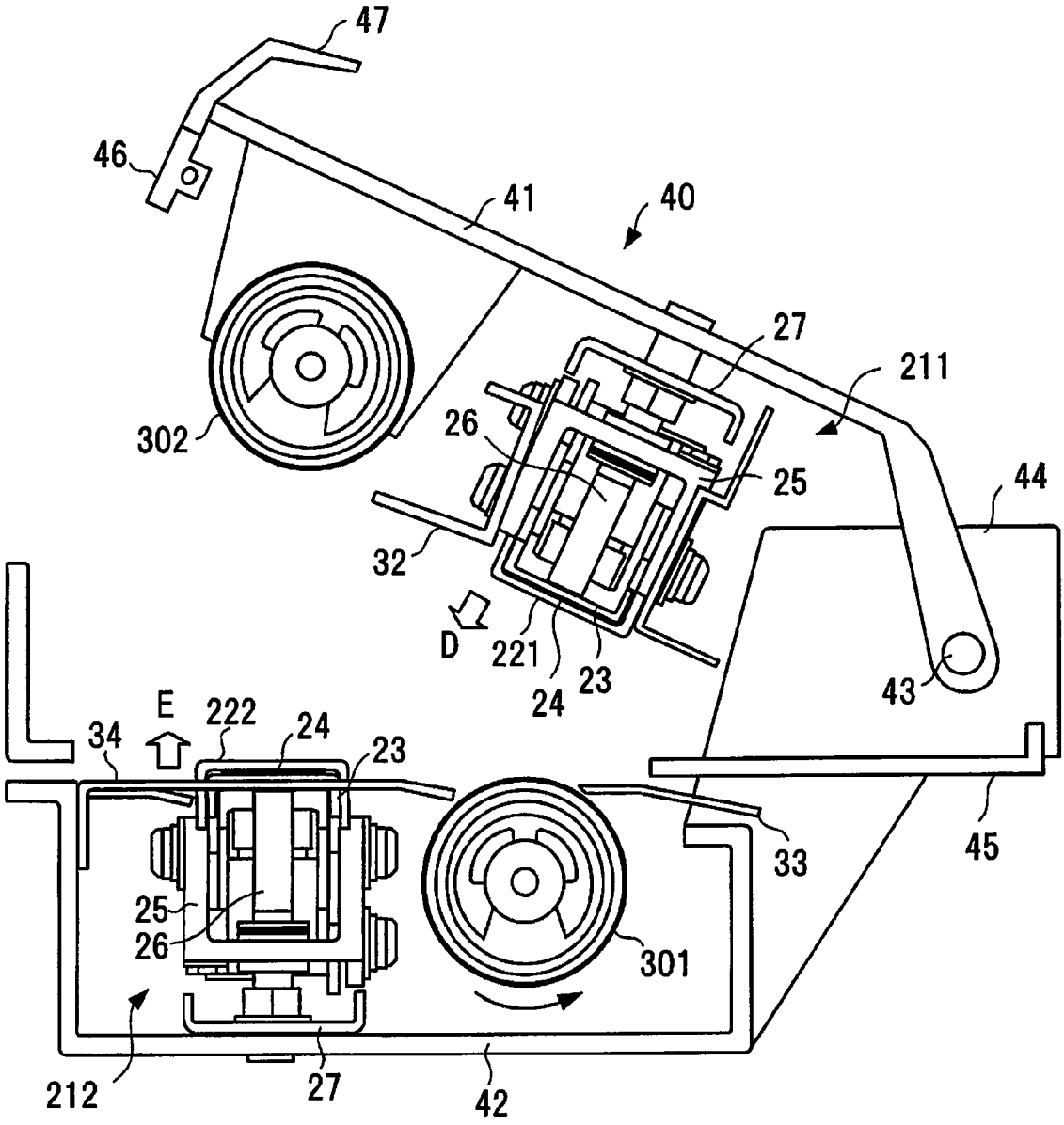
FIG. 13 is a side view of a state in which an upper unit shown in FIG. 12 is opened.

FIGS. 12 and 13 are side views of the first and second decoloring sections 201 and 202 in a fifth embodiment. As shown in FIG. 12, an open-closable case 40 that houses a first decoloring section and a second decoloring section is provided. The case 40 includes an upper unit 41 and a lower unit 42. The first heating section 211 and the platen roller 302 are attached to the upper unit 41. The second heating section 212 and the platen roller 301 are attached to the lower unit 42 of the case 40.

The upper unit 41 can pivot about a rotating shaft 43. For example, the rotating shaft 43 is fixed to a fixing member 44 present on the carry-in side for the sheet S. A bottom 45 of the fixing member 44 functions as a guide on a carry-in port side for the sheet S in cooperation with the guide plate 33.

An opened end of the upper unit 41 is combined with an upper part of the lower unit 42 via a lock mechanism 46. When the upper unit 41 and the lower unit 42 are combined, the platen roller 301 and the heating plate 221 of the heating section 211 are in contact with each other and the platen roller 302 and the heating plate 222 of the heating section 212 are in contact with each other. The sheet S is nipped by the heating plate 221 and the platen roller 301, nipped by the heating plate 222 and the platen roller 302, and conveyed while being heated.

A lever 47 for opening and closing is provided at the opened end of the upper unit 41. The lever 47 is pulled in an arrow C direction and lifted, whereby the lock mechanism 46 is unlocked and the upper unit 41 can be opened.

In FIG. 13, a state in which the upper unit 41 is opened is shown. The first heating section 211 and the platen roller 302 are lifted by opening the upper unit 41. Since the heating section 211 moves away from the platen roller 301, the heating member including the heating plate 221 of the first heating section 211, the pressing member 23, and the heater 24 is projected in an arrow D direction by the spring 26.

Similarly, since the heating section 212 moves away from the platen roller 302, the heating member including the heating plate 222 of the second heating section 212, the pressing member 23, and the heater 24 is projected in an arrow E direction by the spring 26. Therefore, easy to perform work such as cleaning and maintenance of the heating plates 221 and 222, which are heating surfaces.

By forming the screw holes 351 shown in FIG. 5 as long holes, projection amounts of the heating members in the arrow D direction and the arrow E direction can be regulated within a range of the length of the long holes.

Figure 14:
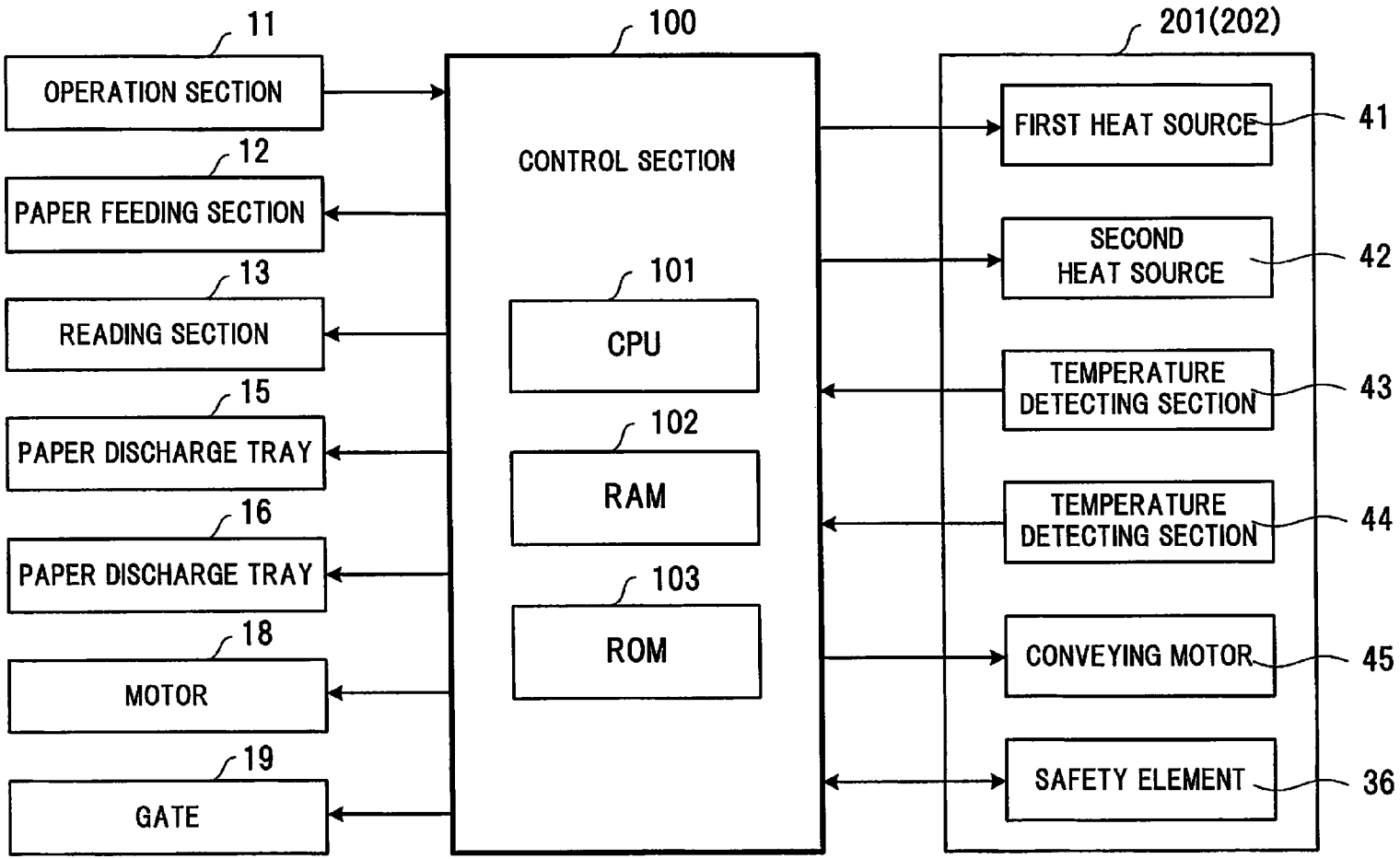
FIG. 14 is a block diagram of a control system of a decoloring apparatus according to an embodiment.

FIG. 14 is a block diagram of a control system of the decoloring apparatus 10 according to an embodiment. The decoloring apparatus 10 includes a control section 100. The control section 100 includes, for example, a processor 101 functioning as a CPU, a random access memory (RAM) 102, and a read only memory (ROM) 103.

The processor 101 executes a control program stored in the ROM 103. The RAM 102 is a main memory functioning as a working memory. The ROM 103 stores the control program and control data for managing the operation of the decoloring apparatus 10.

The control section 100 controls the paper feeding section 12, the scanner 13, the paper discharge trays 15 and 16, the motors 18, and the gates 19 on the basis of an instruction from the operation panel 11. The operation panel 11 includes, for example, a decoloring start button and performs an instruction for decoloring. The paper feeding section 12 feeds sheets, on which images are formed, to the decoloring apparatus 10 one by one. The scanner 13 reads and stores the image of the fed sheet. The scanner 13 reads a print state of the sheet as well. The scanner 13 determines whether the sheet passed through the decoloring section 20 is decolored.

The control section 100 controls the motors 18 to drive the conveying rollers 17 of the first to fifth conveying paths 141 to 145, and control the conveyance of the sheet. Further, the control section 100 controls the gates 19 to convey the sheet to a selected conveying path. The control section 100 performs control to discharge a decolored sheet to the paper discharge tray 15 and discharge an undecolored sheet and a sheet having a tear or a crease to the paper discharge tray 16.

Further, the control section 100 controls ON and OFF of a first heat source 51 and a second heat source 52. The control section 100 controls the temperatures of the first heat source 51 and the second heat source 52 in response to temperature detection results from a first temperature detecting section 53 and a second temperature detecting section 54. The control section 100 controls a conveying motor 55 that drives to rotate the platen rollers 301 and 302.

The first heat source 51 corresponds to the heater 24 of the first decoloring section 201 (or the heat source 241 of the heating roller 213). The second heat source 52 corresponds to the heater 24 of the second decoloring section 202 (or the heat source 242 of the heating roller 214). The first temperature detecting section 53 corresponds to the thermistors 381 and 382 of the first decoloring section 201. The second temperature detecting section 54 corresponds to the thermistors 381 and 382 of the second decoloring section 202. When one of the safety elements 36 of the first decoloring section 201 and the second decoloring section 202 detects abnormal overheat of the heater 24, the control section 100 stops energization to the heater 24 and ensures safety.

Figure 15:
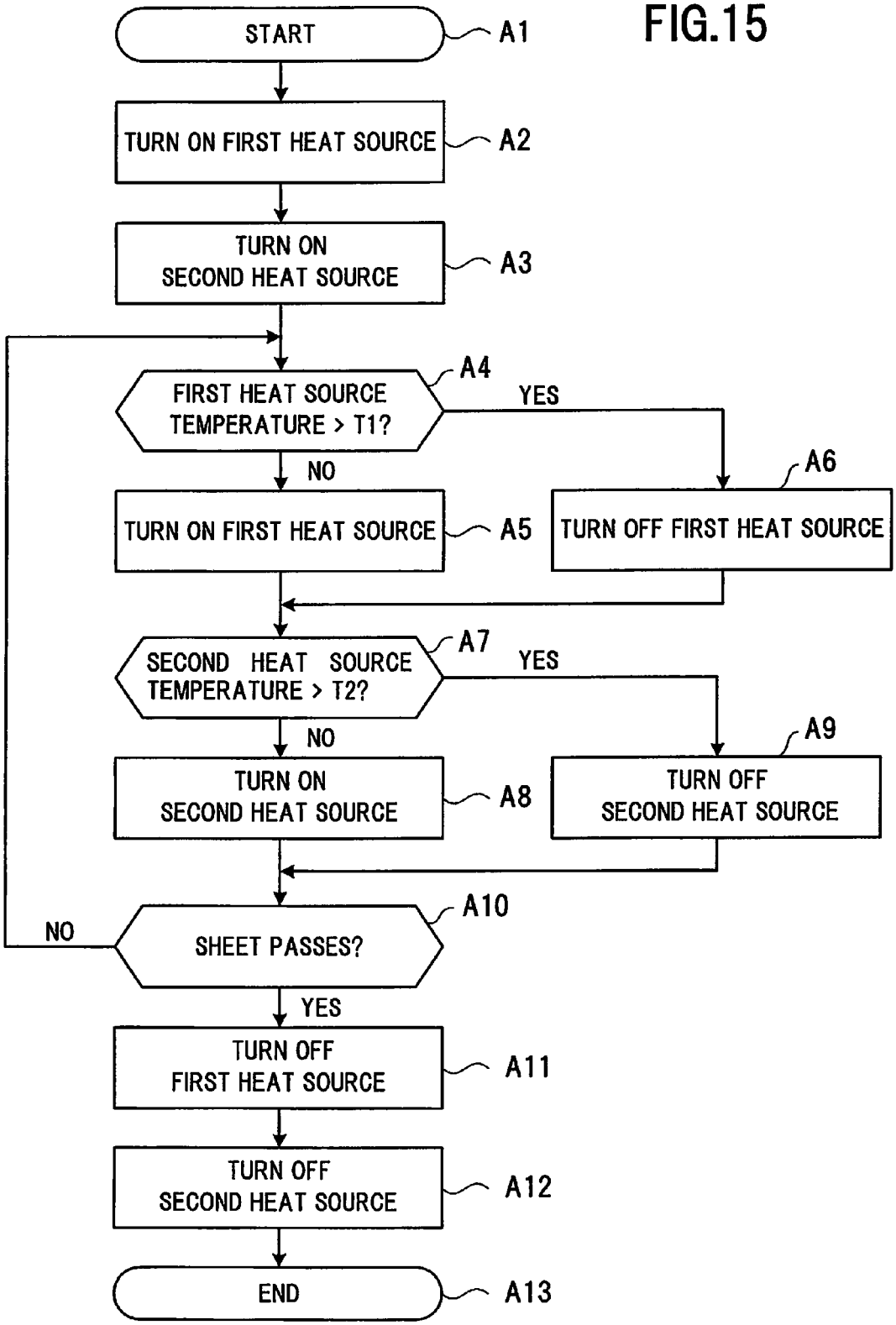
FIG. 15 is a flowchart for explaining a temperature control operation for heat sources in the embodiment.

FIG. 15 is a flowchart for explaining a temperature control operation for the heat sources 51 and 52 by the control section 100. In FIG. 15, Act A1 indicates a start. In Acts A2 and A3, the control section 100 turns on the first heat source 51 and the second heat source 52, respectively (energizes the heater 24).

In Act A4, the control section 100 determines whether the temperature of the first heat source 51 reaches temperature T1 set in advance. If the temperature of the first heat source 51 does not reach the temperature T1, in Act A5, the control section 100 maintains the first heat source 51 on. If the temperature of the first heat source 51 exceeds the temperature T1 in the determination in Act A4, the control section 100 shifts to Act A6 and turns off the first heat source 51.

Specifically, in Act A4, the control section 100 determines, using temperature detection results of the thermistors 381 and 382 of the first heating section 221, whether the temperature of the first heat source 51 reaches the temperature T1. If temperature detected by one of the thermistors 381 and 382 reaches the temperature T1, the control section 100 turns off the first heat source 51.

In Act A7, the control section 100 determines whether the temperature of the second heat source 52 reaches temperature T2 set in advance. If the temperature of the second heat source 52 does not reach the temperature T2, in Act A8, the control section 100 maintains the second heat source 52 on. If the temperature of the second heat source 52 exceeds the temperature T2 in the determination in Act A7, the control section 100 shifts to Act A9 and turns off the second heat source 52.

Specifically, in Act A7, the control section 100 determines, using temperature detection results of the thermistors 381 and 382 of the second heating section 222, whether the temperature of the second heat source 52 reaches the temperature T2. If temperature detected by one of the thermistors 381 and 382 reaches the temperature T2, the control section 100 turns off the second heat source 52. If the temperatures of the first heat source 51 and the second heat source 52 respectively reach the temperatures Ti and T2 set in advance, the sheet S is conveyed to the decoloring section 20.

In Act A10, the control section 100 determines whether the sheet S passes through the decoloring section 20. If the sheet S does not pass through the decoloring section 20, the control section 100 returns to Act A4 and repeats Acts A5 to A10. If the control section 100 determines that the sheet S passes through the decoloring section 20, the control section 100 shifts to Act A11. If plural sheets to be decolored are present, the control section 100 determines in Act A10 that all the sheets pass through the decoloring section 20 and shifts to Act A11. In Act A11, the control section 100 turns off the first heat source 51. In Act A12, the control section 100 turns off the second heat source 52. In Act A13, the control section 100 ends the temperature control operation.

In Act A4 and Act A7, the control section 100 controls the temperatures of the heat sources 51 and 52, respectively, on the basis of temperature detection results of the first and second temperature detecting sections 53 and 54. The set temperatures T1 and T2 in Act A4 and Act A7 are in a relation of T1>T2. Since the sheet S heated by the first decoloring section 201 is preliminarily heated at a stage when the sheet S is carried into the second decoloring section 202, the set temperature T2 can be set lower than the set temperature T1.

According to the embodiments explained above, the arrangement of the heating section 211 and the platen roller 301 of the first decoloring section 201 and the arrangement of the heating section 212 and the platen roller 302 of the second decoloring section 202 are reversed with respect to the conveying path 142. Therefore, possible to accurately decolor both the surfaces of the sheet S.

The nip area X1 where the heating plate 221 and the platen roller 301 of the first decoloring section 201 are in contact with each other is shifted to the position further on the downstream side than the center of the heating surface. Therefore, possible to preheat the sheet S and guide the sheet S to the nip area X1. A temperature rise of the sheet S in the nip area X1 is facilitated. And, possible to suppress flopping of the leading end of the sheet S and guide the leading end of the sheet S to the nip area X1 in a stable state. Since the sheet S is not suddenly cooled, possible to suppress. occurrence of a curl of the sheet S.

On the other hand, in the second decoloring section 202 on the downstream side of the conveying path, since the sheet S is already heated by the first decoloring section 201, possible to set the heating temperature by the heating plate 222 low and save electric power. Further, possible to set the pinch pressure F2 of the platen roller 302 in the second decoloring section 202 small with respect to the pinch pressure F1 of the platen roller 301 in the first decoloring section 201. Therefore, be possible to reduce a mechanical load.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An erasing apparatus for a sheet comprising:

a conveying path configured to convey a sheet on which an image is formed with a coloring agent that is erased by heating;

a first erasing section positioned on an upstream side of the conveying path, the first erasing section including a first heating plate provided on one surface side of the sheet and a first rotating roller provided to be opposed to the first heating plate, the first heating plate having a flat surface that contacts the sheet and is heated by a first planar heater, the first erasing section being configured to convey the sheet according to rotation of the first rotating roller while holding the sheet between the first heating plate and the first rotating roller and heating the sheet; and a second erasing section positioned on a downstream side of the first erasing section, the second erasing section including a second heating plate provided on the other surface side of the sheet and a second rotating roller provided to be opposed to the second heating plate, the second heating plate having a flat surface that contacts the sheet and is heated by a second planar heater, the second erasing section being configured to convey the sheet according to rotation of the second rotating roller while holding the sheet between the second heating plate and the second rotating roller and heating the sheet.

2. The apparatus of claim 1, wherein the first rotating roller configured to contact the first heating plate at a first pressure, and the second rotating roller configured to contact the second heating plate at a second pressure lower than the first pressure.

3. The apparatus of claim 1, wherein the first erasing section and the second erasing section further include temperature detecting elements configured to respectively detect temperatures of the first and second heating plates, and the apparatus further comprises a control section configured to control, in response to detection results of the temperature detecting elements, the temperatures of the first and second planar heaters to be maintained at respective temperatures set in advance.

4. The apparatus of claim 3, wherein the apparatus sets the temperature for heating the sheet with the second erasing section lower than the temperature for heating the sheet with the first erasing section.

5. The apparatus of claim 1, further comprising:

a first pressing member configured to press the first planar heater against the first heating plate, a second pressing member configured to press the second planar heater against the second heating plate, and springs configured to press the first and second heating plates against the first and second rotating roller sides.

6. The apparatus of claim 1, wherein a first nip area where the first heating plate and the first rotating roller are in contact with each other is shifted further to a downstream side in a sheet feeding direction than a center of the first heating plate.

7. The apparatus of claim 6, wherein a second nip area where the second heating plate and the second rotating roller are in contact with each other is shifted further to the downstream side in a sheet feeding direction than a center of the second heating plate.

8. The apparatus of claim 6, wherein a second nip area where the second heating plate and the second rotating roller are in contact with each other is shifted further to an upstream side in a sheet feeding direction than a center of the second heating plate.

9. The apparatus of claim 6, wherein a second nip area where the second heating plate and the second rotating roller are in contact with each other is set in a center of the second heating plate.

10. The apparatus of claim 1, further comprising an open-closable case including an upper unit and a lower unit and configured to house the first erasing section and the second erasing section, wherein the first heating plate and the second rotating roller are attached to the upper unit, the first rotating roller and the second heating plate are attached to the lower unit, and the first heating plate and the first rotating roller are in contact with each other and the second heating plate and the second rotating roller are in contact with each other in a state in which the upper unit and the lower unit are closed.

11. The apparatus of claim 10, wherein, in a state in which the upper unit is opened, a sheet heating surface of the first heating plate extends to the conveying path side by a distance set in advance and a sheet heating surface of the second heating plate extends to the conveying path side by a distance set in advance.

12. An erasing method for a sheet comprising:

conveying, along a conveying path, a sheet on which an image is formed with a coloring agent that is erased by heating;

providing, on an upstream side of the conveying path, a first heating plate on one surface side of the sheet and providing a first rotating roller to be opposed to the first heating plate, the first heating plate having a flat surface that contacts the sheet and is heated by a first planar heater;

conveying the sheet according to rotation of the first rotating roller and performing erasing of the images on a first side of the sheet while holding the sheet between the first heating plate and the first rotating roller and heating the sheet;

providing, on a downstream side of the first erasing section, a second heating plate on the other surface side of the sheet and providing a second rotating roller to be opposed to the second heating plate, the second heating plate having a flat surface that contacts the sheet and is heated by a second planar heater; and conveying the sheet according to rotation of the second rotating roller, performing erasing of the images on a second side of the sheet while holding the sheet between the second heating plate and the second rotating roller, heating the sheet and discharging the sheet.

13. The method of claim 12, further comprising:

bringing the first rotating roller into contact with the first heating plate at first pressure; and bringing the second rotating roller into contact with the second heating plate at a second pressure lower than the first pressure.

14. The method of claim 12, further comprising:

detecting temperatures of the first and second heating plates while in performing the erasing of the first and second sides of the paper, respectively; and controlling the first and second planar heaters to be maintained at respective temperatures set in advance in response to a result of the temperature detection.

15. The method of claim 14, further comprising setting a temperature for heating the sheet in performing the erasing of the second side of the paper to be lower than a temperature for heating the sheet in performing the erasing of the first side of the paper.

16. The method of claim 12, wherein a first nip area where the first heating plate and the first rotating roller are in contact with each other is shifted further to a downstream side in a sheet feeding direction than a center of the first heating plate.

17. The method of claim 16, wherein a second nip area where the second heating plate and the second rotating roller are in contact with each other is shifted further to the downstream side in a sheet feeding direction than a center of the second heating plate.

18. The method of claim 16, wherein a second nip area where the second heating plate and the second rotating roller are in contact with each other is shifted further to an upstream side in a sheet feeding direction than a center of the second heating plate.

19. The method of claim 16, wherein a second nip area where the second heating plate and the second rotating roller are in contact with each other is set in a center of the second heating plate.

* * * * *